US005349903A

United States Patent [19]

Moriyama et al.

[11] Patent Number: 5,349,903

[45] Date of Patent: Sep. 27, 1994

[54] PRINTING HEAD IN WIRE-DOT PRINTER

[75] Inventors: Hitoshi Moriyama; Kiyoshi Itoh; Minoru Hara; Masahisa Inagaki, all of Kawasaki, Japan

[73] Assignee: Fujitsu Limited, Kawasaki, Japan

[21] Appl. No.: 985,480

[22] Filed: Dec. 4, 1992

[30] Foreign Application Priority Data

Dec. 5, 1991 [JP] Japan ..... 3-321852
Mar. 2, 1992 [JP] Japan ..... 4-044496

[51] Int. Cl.[5] ..... B41J 2/245

[52] U.S. Cl. ..... 101/93.05; 400/124.12

[58] Field of Search ..... 101/93.04, 93.05, 93.29, 101/93.3, 93.31, 93.32, 93.33, 93.34, 93.48; 400/121, 124, 124 GT

[56] References Cited

U.S. PATENT DOCUMENTS

| | | | |
|---|---|---|---|
| 4,268,180 | 5/1981 | Honma | 101/93.05 |
| 4,351,235 | 9/1982 | Bringhurst | 101/93.04 |
| 4,373,440 | 2/1983 | Jezbera | 101/93.48 |
| 4,532,862 | 8/1985 | Moss | 101/93.48 |
| 4,572,070 | 2/1986 | Moulin | 101/93.05 |
| 4,675,568 | 6/1987 | Uchikawa et al. | 101/93.48 |
| 4,700,625 | 10/1987 | Bauer | 101/93.05 |
| 4,867,583 | 9/1989 | Caulier et al. | 400/124 |
| 5,046,871 | 9/1991 | Saitou et al. | 101/93.05 |
| 5,048,985 | 9/1991 | Mitsuishi et al. | 400/124 |
| 5,169,246 | 12/1992 | Bernardis et al. | 101/93.05 |
| 5,237,918 | 8/1993 | Kobayashi et al. | 101/93.04 |
| 5,241,904 | 9/1993 | Kobayashi et al. | 101/93.04 |

FOREIGN PATENT DOCUMENTS

| | | | |
|---|---|---|---|
| 207654 | 8/1988 | Japan | 101/93.04 |
| 64-40345 | 2/1989 | Japan . | |
| 58566 | 3/1989 | Japan | 101/93.04 |
| 291953 | 11/1989 | Japan | 101/93.04 |
| 3331 | 1/1990 | Japan | 101/93.04 |
| 2-202454 | 8/1990 | Japan . | |
| 3-73356 | 3/1991 | Japan . | |

*Primary Examiner*—David A. Wiecking
*Attorney, Agent, or Firm*—Nikaido, Marmelstein, Murray & Oram

[57] ABSTRACT

A printing head provided in a wire-dot printer includes a plurality of first wire pins arranged in accordance with a predetermined rule, ends of the first wire pins facing a printing plane, a first driving mechanism for reciprocating the first wire pins in directions approximately perpendicular to the printing plane, a plurality of second wire pins longer than the first wire pins, ends of the second wire pins facing the printing plane, and a second driving mechanism for reciprocating the second wire pins in the same directions as the first wire pins, wherein the first and second driving mechanisms are arranged along a direction approximately perpendicular to the printing plane under a condition in which the first driving mechanism is positioned nearer the printing plane than the second driving mechanism.

12 Claims, 14 Drawing Sheets

PRINTING HEAD IN WIRE-DOT PRINTER

BACKGROUND OF THE INVENTION (1) Field of the invention

The present invention generally relates to a printing head in a wire-dot printer, and particularly to a printing head in a wire-dot printer in which the head has two types of wire pins.

(2) Description of related art

In a wire-dot printer, a recording sheet is put between a printing head and a platen, and wire pins of the printing head hammer the recording sheet via an ink ribbon against the platen, so that characters corresponding to the arrangement of the hammering wire pins are printed on the recording sheet. Recently, high speed wire-dot printers have become desired with the increasing amount of printing needed in offices, factories and distribution sections. To improve the printing rate (the printing speed), increasing the number of wire pins provided in a wire-dot printer is a valid approach.

A conventional wire-dot printer is shown in FIG. 1. Referring to FIG. 1, a wire-dot printer has a paper feed unit 1, a printing head unit 2 and a shuttle unit 3. While the printing head unit 2 having a large number of wire pins is being moved from side to side by the shuttle unit 3, printing of characters is performed.

The paper feed unit 1 has a platen 4 and a tractor 5 for feeding a recording paper 100 (a continuous form) upward. The platen and the tractor 5 are driven by a feeding motor 6. The printing head unit 2 has a plurality of heads 7 arranged side to side. Each of heads 7 has a plurality of wire pins which is arranged in a line as shown in FIG. 2A. The wire pins provided in each of the heads 7 may be arranged in a slanting line, as shown in FIG. 2B. The shuttle unit 3 has a linear motor, and moves the printing head 2 from side to side within a predetermined region. While the printing head unit 2 is being moved by the shuttle unit 3, wire pins selected in accordance with image data hammer the recording paper 100 via an ink ribbon (not shown), supplied by an ink ribbon supplier (not shown), against the platen. Due to the hammering of the wire pins, characters corresponding to the image data are successively printed on the recording paper 100.

There are various types of printing head, such as a disengaging type, a moving-coil type and a piezo-electric type.

FIG. 3A shows the disengaging type printing head 7A. Referring to FIG. 3A, two head modules $7A_1$ and $7A_2$ are fixed on a frame 11 so that the head modules $7A_1$ and $7A_2$ face each other in a vertical direction. Each of the head modules $7A_1$ and $7B_2$ has a wire pin unit 12 formed of a leaf spring 8, an armature 9, a beam 10 and a wire pin 10*a* and a magnet unit 16 formed of a magnet 13, a coil 14 and a core block 15. In the wire pin unit 12, the leaf spring 8 and the armature 9 are successively connected to each other by a welding process. A wire pin 10*a* is mounted on an end of the beam 10 so as to be inserted into a pin guide 17. The armature 9 is normally attracted by the core block 15, and the armature 9 is disengaged from the core block 15 by the righting moment of the leaf spring 8 when an electric current is supplied to the coil 14. Due to the disengagement of the armature 9 from the core block 15, the wire pin 10*a* projects from the pin guide 17, and the tip end of the wire pin 17 then hammers the recording paper via the ink ribbon. In a 24-dot-matrix printing type head, the printing end of the wire pins of the printing head are arranged, for example, in an array of straight lines as shown in FIG. 3B.

FIG. 4A shows a moving coil type printing head 7B, and FIG. 4B shows an essential part of the moving coil type printing head. Referring to FIGS. 4A and 4B, two head modules $7B_1$ and $7B_2$ are provided on a supporting block so as to face each other in a vertical direction. In each of the head modules $7B_1$ and $7B_2$, a flat coil 18 is mounted on a surface of a base 19, and a set of the flat coil 18 and the base 19 is arranged in each interval between the magnets 20. When an electric current is supplied to the flat coil 18, the flat coil 18 is moved in a direction indicated by an arrow in FIG. 4B, so that a wire pin 21 mounted on an end of the base 19 by welding process projects from the supporting block.

FIG. 5A shows a piezo-electric type printing head 7C, and FIG. 5B shows an essential part of the piezo-electric type printing head. Referring to FIGS. 5A and 5B, two head modules $7C_1$ and $7C_2$ are mounted on a supporting block 29 so as to face each other in a vertical direction. Each of the head modules $7C_1$ and $7C_2$ comprises a plurality of printing elements 28. Each of the printing elements 28 shown in FIG. 5B is formed of a base member 22, a piezo-electric element 23 (a laminated type), a block 24, two leaf springs $25_1$ and $25_2$, a beam 26 and a wire pin 27. When a voltage is supplied to the piezo-electric element 23, the piezo electric element 23 expands slightly. The amount of expansion of the piezo-electric element 23 is enlarged by the leaf springs $25_1$ and $25_2$, and the beam 26 is moved so that the wire pin 27 mounted on an end of the beam 26 projects from a pin guide 30 formed on the supporting block 29.

In the above various types of wire-dot printer, to increase the number of wire pins, two head modules are mounted on the supporting block so as to be close to each other in the vertical direction. Further, to print kanji characters each formed of a 24×24 dot matrix at a high rate, 24 wire pins are arranged in a slanting line, as shown in FIG. 3B. Due to the arrangement of the wire pins, the printing rate was improved, for example, from 150 LPM (lines per minutes) to 300–400 LPM.

However, as the intervals at which the wire pins are arranged depends on the size of the coil, the width of the leaf spring and the like, the number of wire pins capable of being provided in the printing head is limited.

SUMMARY OF THE INVENTION

Accordingly, a general object of the present invention is to provide a novel and useful printing head in which the disadvantages of the aforementioned prior art are eliminated.

A more specific object of the present invention is to provide a printing head in which the number of the wire pins provided therein can be increased.

The above objects of the present invention are achieved by a printing head provided in a wire-dot printer comprising: a plurality of first wire pins arranged in accordance with a predetermined rule, ends of the first wire pins facing a printing plane; a first driving mechanism for reciprocating the first wire pins in directions approximately perpendicular to the printing plane; a plurality of second wire pins longer than the first wire pins, ends of the second wire pins facing the printing plane; and a second driving mechanism for reciprocating the second wire pins in the same directions as the first wire pins, wherein the first and second driving mechanisms are arranged along a direction approximately perpendicular to the printing plane such that the first driving mechanism is positioned nearer the printing plane than the second driving mechanism.

According to the present invention, the first driving mechanism for reciprocating the first wire pins and the second driving mechanism for reciprocating the second wire pins are arranged in a direction approximately perpendicular to the printing plane such that the first driving mechanism is positioned nearer the printing plane than second driving mechanism. Thus, the number of wire pins provided with the printing head can be increased. As a result, high quality prints can be made at a high rate.

Additional objects, features and advantages of the present invention will become apparent from the following detailed description when read in conjunction with the accompanying drawings.

DESCRIPTION OF THE PREFERRED EMBODIMENTS

A description will now be given, with reference to FIGS. 6A–9, of an embodiment of the present invention.

Figure 1:
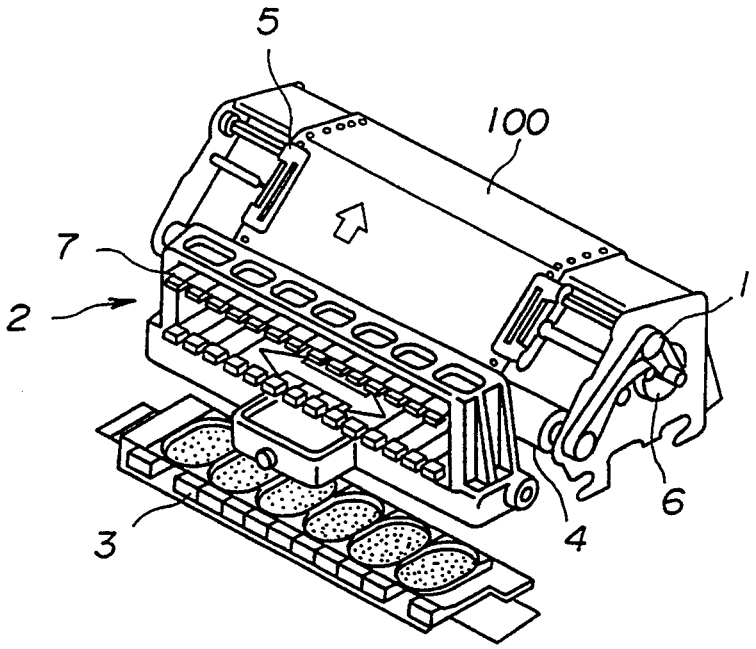
FIG. 1 (PRIOR ART)
FIG. 1 is a perspective view illustrating an essential part of a conventional wire-dot printer.
Figure 2B:
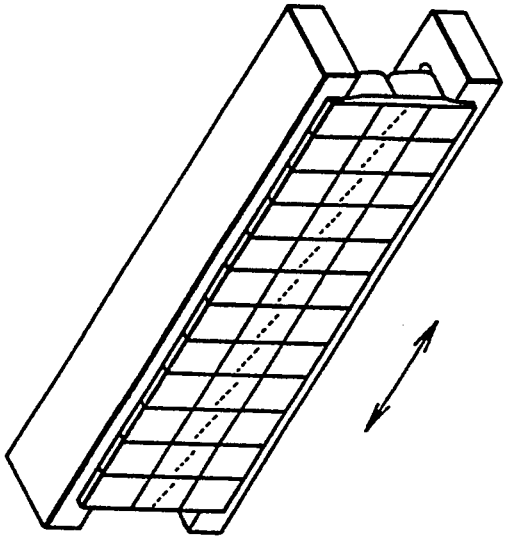
FIG. 2B (PRIOR ART)
FIG. 2A and 2B are diagrams illustrating arrangements of wire pins of the wire-dot printer.
Figure 2A:
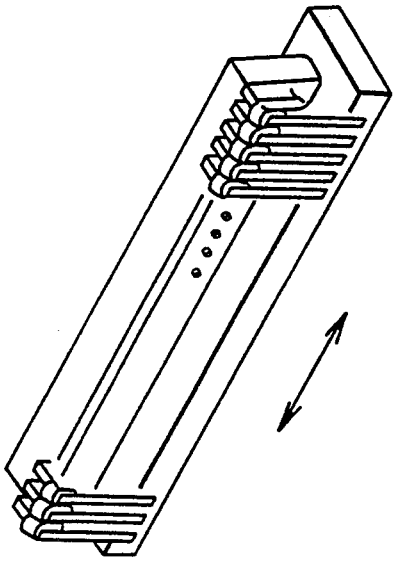
FIG. 2A (PRIOR ART)
Figure 3A:
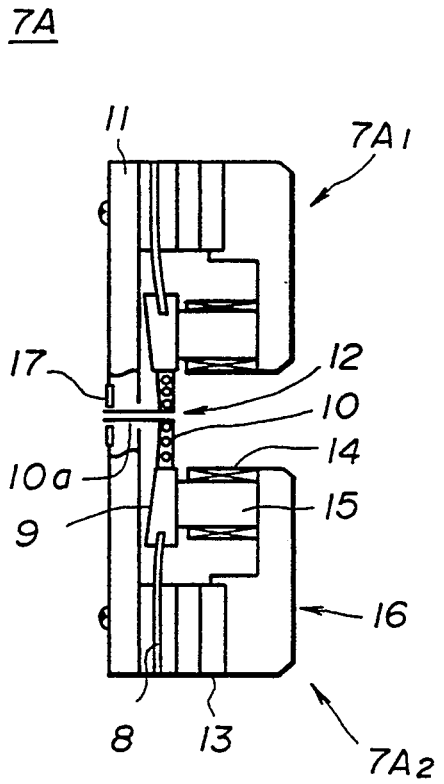
FIG. 3A (PRIOR ART)
FIG. 3A is a diagram illustrating an essential part of a disengaging type printing head.
Figure 3B:
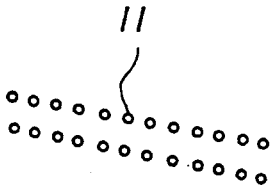
FIG. 3B (PRIOR ART)
FIG. 3B is a diagram illustrating arrangement of wire pins provided in the disengaging type printing head shown in FIG. 3A.
Figure 4A:
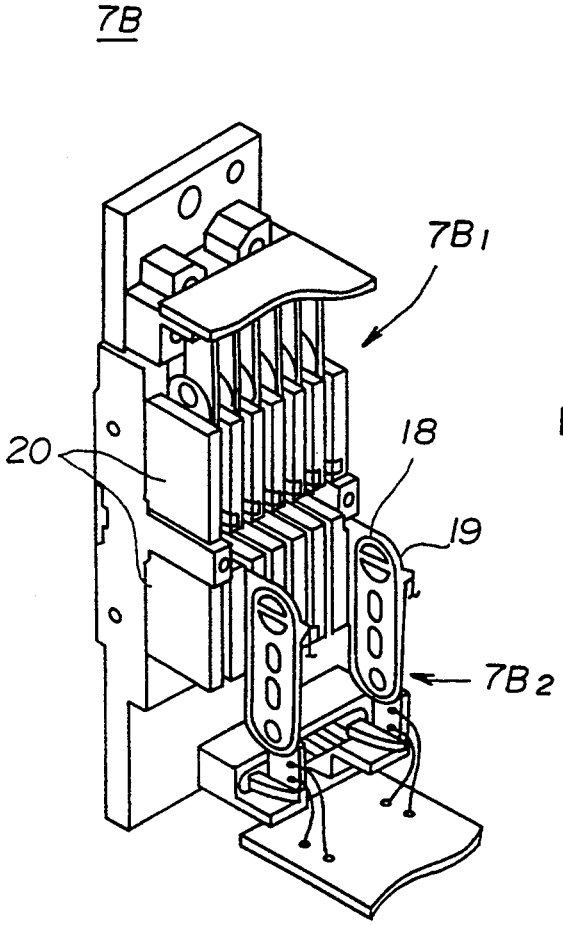
FIG.4A (PRIOR ART)
FIG. 4A and 4B are perspective views illustrating an essential part of a moving coil type printing head.
Figure 4B:
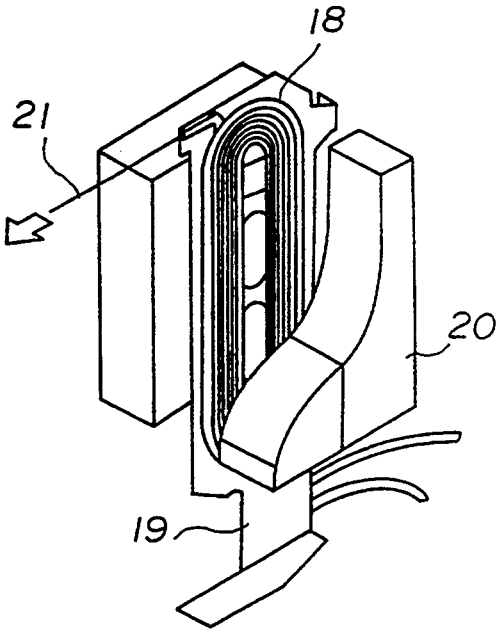
FIG.4B (PRIOR ART)
Figure 5A:
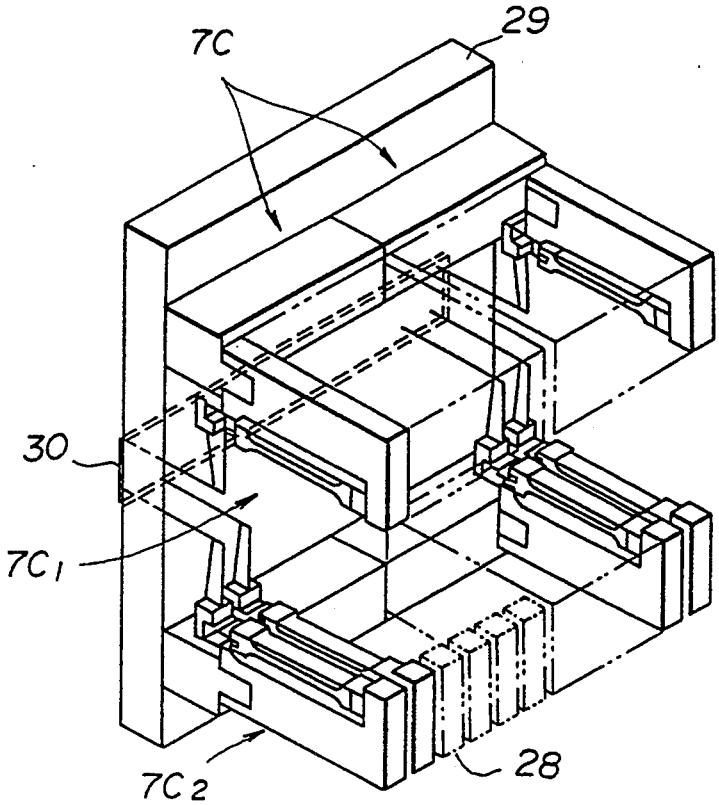
FIG.5A(PRIOR ART)
FIG. 5A and 5B are diagram illustrating an essential part of a piezo-electric type printing head.
Figure 5B:
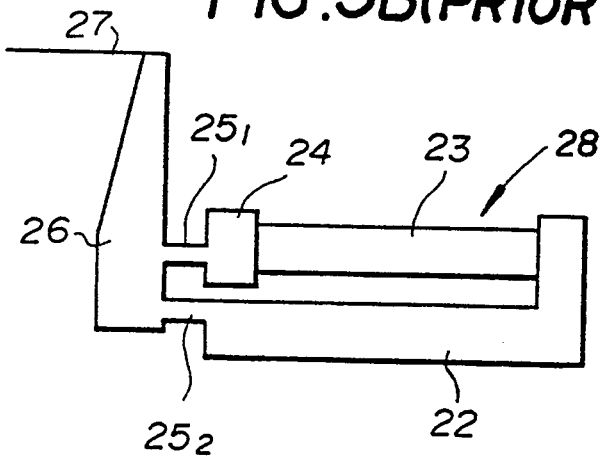
FIG.5B(PRIOR ART)
Figure 6B:
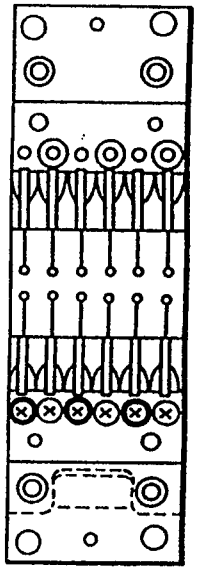
FIG. 6B is a front view illustrating the disengaging type printing head.
Figure 6A:
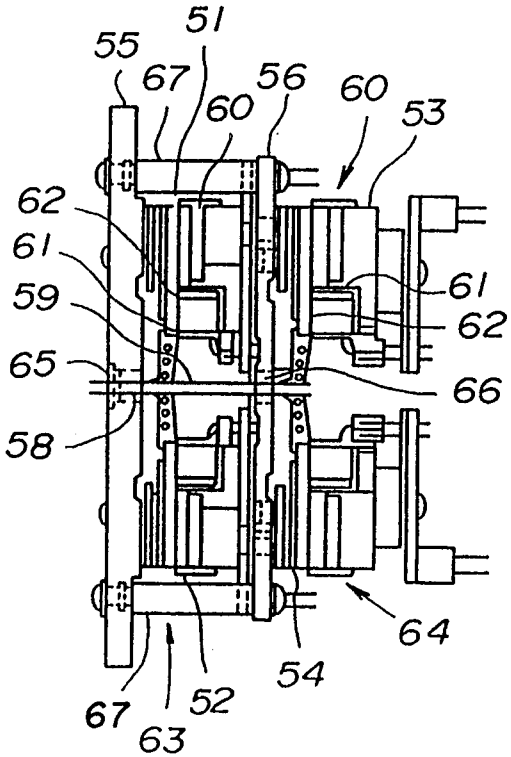
FIG. 6A is a side view illustrating a disengaging type printing head according to an embodiment of the present invention.
Figure 6C:
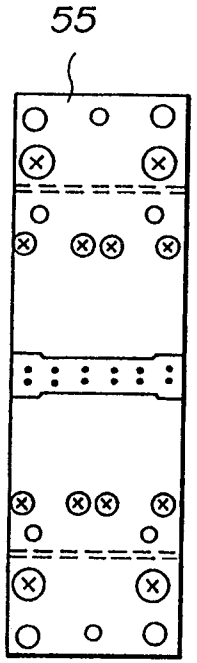
FIG. 6C is a rear view illustrating the disengaging type printing head.

FIGS. 6A, 6B and 6C show a structure of a disengaging type printing head 50. Referring to FIGS. 6A, 6B and 6C, a first head module 51 and a second head module 52 are mounted on a first frame member 55. Each of the first and second head modules 51 and 52 has six first wire pins 58 each of which is driven by a mechanism formed of a magnet 60, a coil 61 and an armature 62 in the same manner as each wire pin shown in FIG. 3A. The first wire pins 58 are arranged at predetermined intervals in a direction approximately perpendicular to the plane of FIG. 6A. Each of the first wire pins 58 is mounted on an end of the armature 62, and the first and second head modules 51 and 52 are arranged on the first frame member 55 so that the first wire pins of the first and second head modules 51 and 52 closely face each other. Each of the first wire pins 58 is positioned and guided by a pin guide 65 formed on the first frame member 55. The first and second head modules 51 and 52 form a first sub-head 63 having 12 wire pins.

A third head module 53 and a fourth head module 54 are mounted on a second frame member 56. Each of the third and fourth head modules 53 and 54 has six second wire pins 59 each of which is driven by the mechanism formed of the magnet 60, the coil 61 and the armature 62 in the same manner as each first wire pin. Each of the second wire pins 59 is longer than each of the first wire pins 58. The second wire pins 59 are also arranged at predetermined intervals in a direction approximately perpendicular to the plane of FIG. 6A. The third and fourth head modules 53 and 54 are arranged on the second frame member 56 so that the second wire pins 59 of the third and fourth head modules 53 and 54 closely face each other in the same manner as the first and second head modules 51 and 52. Each of the second wire pins 59 freely passes through a pin guide 66 formed on the second frame member 56. The third and fourth head modules 53 and 54 form a second sub-head 64 having 12 wire pins.

Figure 7:
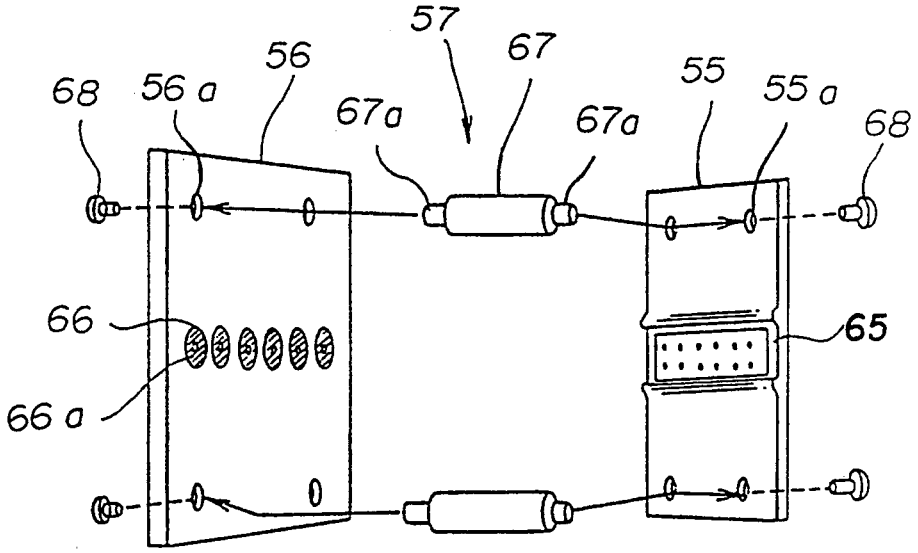
FIG. 7 is an exploded perspective view illustrating a structure of a connecting mechanism.

The first and second frame members 55 and 56 are connected by a connecting mechanism 57 as shown in FIG. 7 so that the first and second head modules 51 and 52 are located between the first and second frame members 55 and 56. Referring to FIG. 7, the first and second frame member 55 and 56 are connected by four spacing rods 67 (FIG. 7 shows only two spacing rods, and remaining spacing rods are omitted therefrom.) Each of the spacing rods 67 is provided with engaging portions **67*a* formed at both ends thereof. The first and second frame members 55 and 56 are respectively provided with positioning holes 55*a* and 56*a* formed at corners thereof. The engaging portions 67*a* of each of the spacing rods 67 are engaged with corresponding positioning holes 55*a* and 56*a* of the first and second frame members 55 and 56 so that the first and second frame members 55 and 56 are connected such that a space is formed between them. The first and second head modules 51 and 52 are positioned in this space, as shown in FIG. 6. Both ends of each of the spacing rods 67 are fixed to the first and second frame members 55 and 56 by screws 68. In FIG. 7, each of the guide holes 66 formed on the second frame member 56 is engaged with a bush 66*a* having a hole. The bush 66*a* is made of resin. Each of the second wire pins passes through the hole formed on the bush 66a**.

Under a condition in which the first and second frame members 55 and 56 are connected by the connecting mechanism described above, tip end portions of the second wire pins 59 of the second sub-head 64 (the third and fourth head modules 53 and 54) mounted on the second frame member 56 are guided and positioned by the pin guide 65 formed in the first frame member 55. The tip ends of the first wire pins 58 of the first sub-head 63 and the tip ends of the second wire pins 59 of the second sub-head 64 are flush with each other. As this printing head 50 has twelve first wire pins 58 and twelve second wire pins 59, the total number of wire pins provided in this printing head 50 is equal to twenty-four.

Figure 8A:
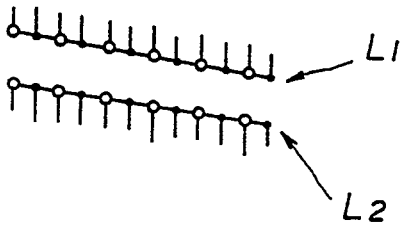
FIGS. 8A, 8B and 8C are diagrams illustrating arrangements of the wire pins.
Figure 8B:
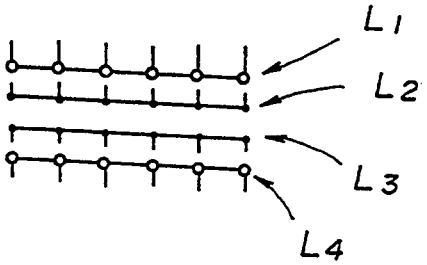
Figure 8C:
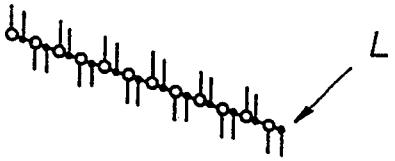

The first and second wire pins 58 and 59 are arranged in an array of one or more straight lines as shown in FIGS. 8A–8C. In FIGS. 8A–8C, symbols ∘ and • respectively indicate the first and second wire pins 58 and 59.

In FIG. 8A, wire pins are alternately arranged in an array of two slanting lines. In the first slanting line $L_1$, the six first wire pins 58 of the first head modules 51 and the six second wire pins 59 of the third head module 53 are alternately arranged at predetermined intervals. In the second slanting line $L_2$, the six first wire pins 58 of the second head module 52 and the six second wire pins 59 of the fourth head module 54 are alternately arranged at the same intervals as in the first slanting line $L_1$.

In FIG. 8B, wire pins are arranged in an array of four slanting lines. In the first, second, third and fourth slanting lines $L_1$, $L_2$, $L_3$ and $L_4$, the six first wire pins of the first head module 51, the six second wire pins of the third head module 53, the six second wire pins of the fourth head module 54 and the six first wire pins of the second head modules 52 are respectively arranged at predetermined intervals.

In FIG. 8C, wire pins are arranged in an array forming a single slanting line L. Pairs of first and second wire pins of first and third head modules 51 and 53 and pairs of first and second wire pins of second and fourth head modules 52 and 54 are alternately arranged in the slanting line L.

Each of the intervals at which the wire pins of each head module are arranged depends on the width of each coil 61. However, the coil 61 corresponding to each first wire pin 58 and the coil 61 corresponding to each second wire pin 59 are not close to each other. Thus, in a case where the first wire pins and the second wire pins (longer than the first wire pins) are alternately arranged as shown in FIGS. 8A and 8C, the intervals between the first and second wire pins can be decreased. In addition, the number of lines in an array in which the wire pins are arranged can also be increased, as shown in FIG. 8B. According to the above structure of the printing head, the number of wire pins (twenty-four) provided in the printing head is twice as large as the number of wire pins (twelve) provided in the conventional printing head.

Figure 9:
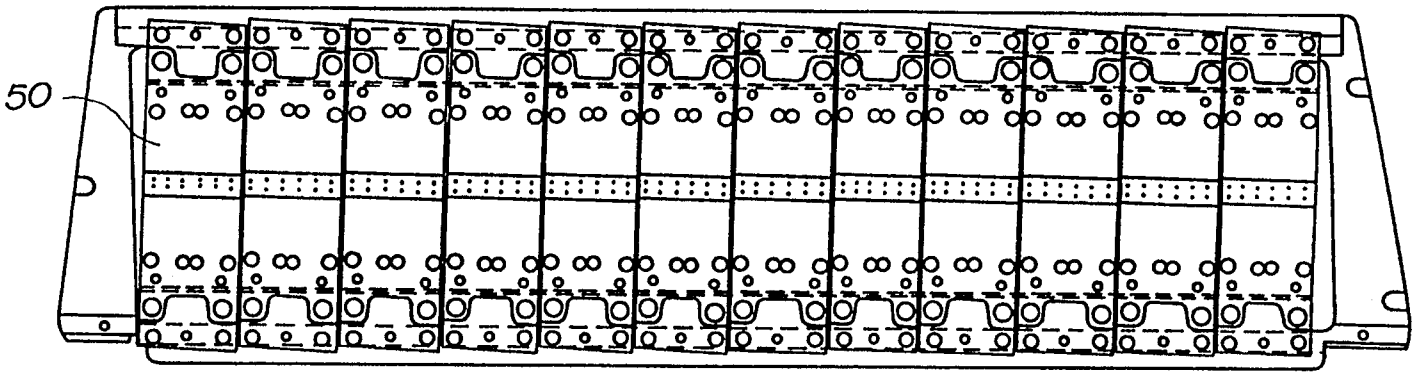
FIG. 9 is a rear view illustrating a printing head unit formed of a plurality of printing heads each of which is shown in FIGS. 6A, 6B and 6C.

In the wire-dot printer, a plurality of printing heads 50 each having the above structure are connected to each other so that a printing head unit 69 is formed as shown in FIG. 9. While the printing head unit 69 is being moved by the shuttle unit from side to side, characters are printed on the recording paper.

Figure 10A:
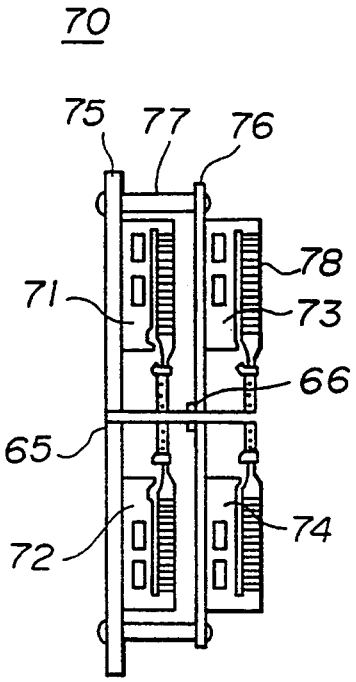
FIG. 10A and 10B are diagrams illustrating a piezoelectric type printing head according to another embodiment of the present invention.

FIG. 10A shows an example of a structure of a piezo-electric type printing head 70. Referring to FIG. 10A, a first head module 71 and a second head module 72 are mounted on a first frame member 75, and a third head module 73 and a fourth head module 74 are mounted on a second frame member 76, in the same manner as in the disengaging type printing head 50. Each of the head modules 71, 72, 73 and 74 is provided with a piezo-electric element 78 for driving a wire pin. The first and second frame members 75 and 76 are connected by a connecting mechanism 77 so that the third and fourth head modules 73 and 74 are positioned behind the first and second head modules 71 and 72. Each of the second wire pins provided in the third and fourth head modules 73 and 74 is longer than each of the first wire pins provided in the first and second head modules 71 and 72. The tip ends of the first and second wire pins provided in the first, second, third and fourth are flush with each other. The piezo-electric element 78 provided in each of the head modules 71, 72, 73 and 74 is a laminated type piezo-electric element. The laminating direction of the piezo-electric element 78 is parallel to the surfaces of the first and second frame members 75 and 76. Thus, the thickness of the printing head 70 in the direction in which the wire pins are projected can be less than the thickness of the disengaging type printing head 50 shown in FIGS. 6A, 6B and 6C. That is, the second wire pins to be provided in the third and fourth head may be shorter than those provided in the disengaging type printing head 50 shown in FIGS. 6A, 6B and 6C. As a result, a driving frequency of each second wire pin does not need to be decreased. In this type of printing head 70, the intervals at which the wire pins are arranged in each head module depend on the thickness of the piezo-electric element 78.

Figure 10B:
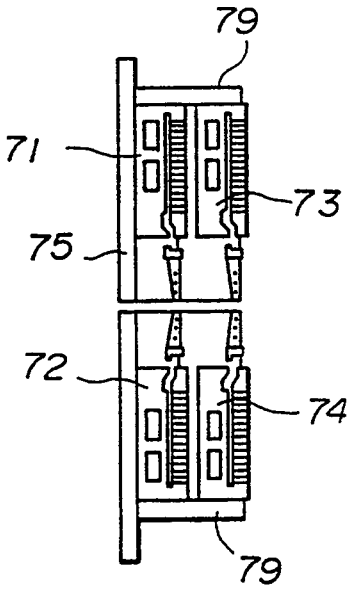

The third and fourth head modules 73 and 74 to be positioned behind the first and second head modules 71 and 72 may be mounted on blocks 79 fixed on the first frame member 75 instead of being mounted on the second frame member 76, as shown in FIG. 10B.

In a moving coil type printing head, four head modules can be arranged in the same manner as those in the disengaging type printing head 50 as shown in FIGS. 6A, 6B and 6C and the piezo-electric type printing head 70 as shown in FIGS. 10A and 10B. In the moving coil type printing head, the intervals at which the wire pins are arranged in each head module depend on the thickness of the magnet.

Figure 15:
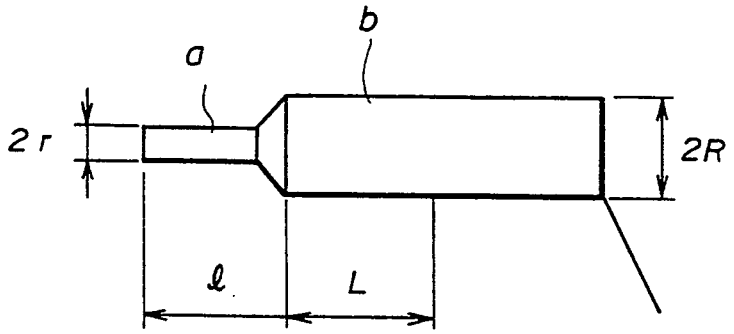
FIG. 15 is a diagram illustrating each wire pin.

The tip end of each wire pin must be thin. The diameter of the tip end of each wire pin must normally be about 0.2 mm. Each of the wire pins must have strength sufficient to support reaction of printing pressure. Thus, each wire pin is formed of a thin portion (a) positioned at the end thereof and a thick portion (b) as shown in FIG. 15. The thin portion (a) and the thick portion (b) are respectively referred to as the end portion and the supporting portion.

The longer the end portion (the thin portion) of the wire pin, the more easily the wire pin is bent and the lower the printing pressure. As a result, the quality of printing deteriorates. The longer the supporting portion (the thick portion) of the wire pin, the larger the moving mass and the lower the driving frequency of the wire pin. As a result, the printing rate is reduced.

In the printing head provided with the first and second wire pins whose lengths differ from each other as has been described above, the first and second wire pins must be uniformly driven.

A description will now be given of a printing head having first and second wire pins whose lengths differ from each other which head can make high quality prints at a high printing rate.

Figure 11:
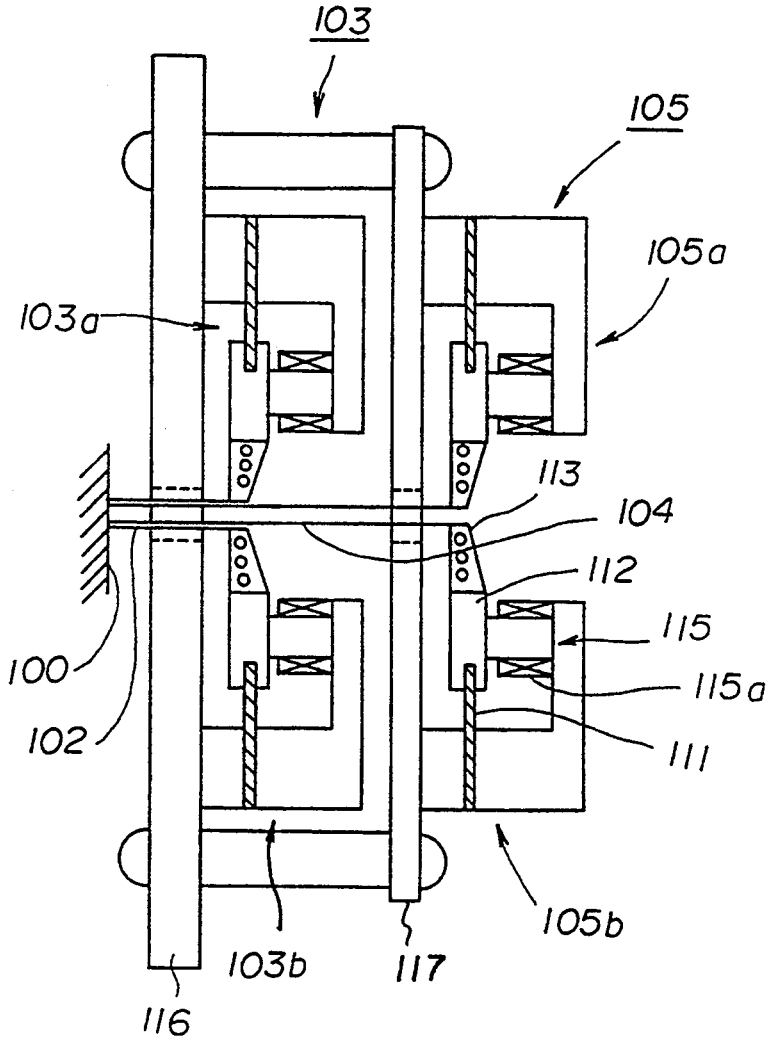
FIG. 11 is a diagram illustrating a printing head according to another embodiment of the present invention.
Figure 12:
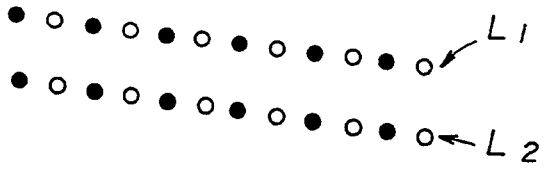
FIG. 12 is a diagram illustrating an arrangement of wire pins provided in the printing head shown in FIG. 11.

FIG. 11 shows a disengaging type printing head. Referring to FIG. 11, a first head module 103*a* and a second head module 103*b* are mounted on a first supporting plate 116, and a third head module 105*a* and a fourth head module 105*b* are mounted on a second supporting plate 117, in the same manner as the printing head shown in FIGS. 6A, 6B and 6C. The first supporting plate 116 and the second supporting plate 117 are connected by a connecting mechanism so that the first and second head modules 103*a* and 103*b* are located between the first and second supporting plates 116 and 117. Each of the first and second head modules 103*a* and 103*b* has first wire pins 102, each of which is driven by a mechanism formed of a leaf spring 111, a beam 112, an armature 113 and an electromagnet 115 having an electro-magnetic coil 115*a* in the same manner as the first wire pins shown in FIGS. 3A and 6A. Each of the third and fourth head modules 105*a* and 105*b* has second wire pins 104, each of which is also driven by a mechanism formed of the leaf spring 111, the beam 12 and the armature 113 and the electromagnet 115. Each of the first wire pins 102 is shorter than each of the second wire pins 104. The tip end of each of the first wire pins 102 and the tip end of each of the second pins 104 are flush with each other and face a printing plane 100 (e.g. a surface of the recording paper). The first and second wire pins 102 and 104 are arranged as shown in FIG. 12. In FIG. 12, a symbol ○ indicates each of first wire pins 102, and a symbol • indicates each of the second wire pins 104. That is, the first wire pins 102 provided in the first head module 103*a* and the second wire pins 104 provided in the third head module 105*a* are alternately arranged in a slanting line $L_1$, and the first wire pins provided in the second head module 103*b* and the second wire pins provided in the fourth head module 105*b* are alternately arranged in a slanting line $L_2$ parallel with the pins in line $L_1$. The set of the first and second head modules 103*a* and 103*b* is referred to as a front printing head 103, and the set of the third and fourth head modules 105*a* and 105*b* is referred to as a rear printing head 105.

Figure 13:
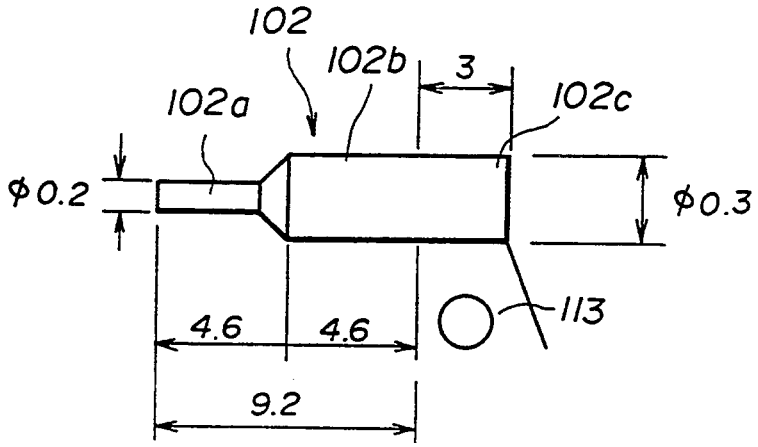
FIG. 13 is a diagram illustrating a structure of each of first wire pins provided in the printing head shown in FIG. 11.
Figure 14:
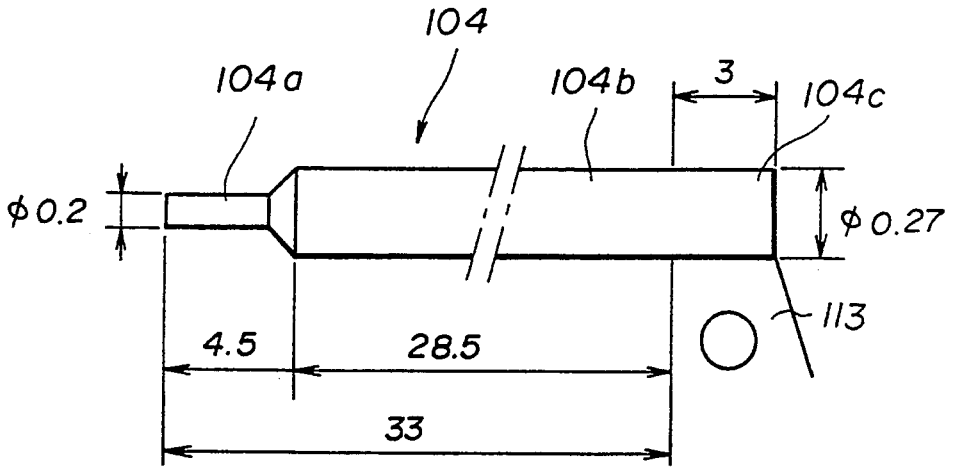
FIG. 14 is a diagram illustrating a structure of each of second wire pins provided in the printing head shown in FIG. 11.

Each of the first and second wire pins are made, for example, of steel having a weight density of 7.8 g/cm$^3$. An example of dimensions of each of the first wire pins is shown in FIG. 13. Referring to FIG. 13, each of the first wire pins 102 is formed of an end portion 102*a*, a supporting portion 102*b* and a mounting portion 102*c*. The mounting portion 102*c* is fixed at the end of the armature 113. The diameter and length of the end portion 102*c* are respectively 0.2 mm and 4.6 mm, the diameter and length of the supporting portion 102*b* are respectively 0.3 mm and 4.6 mm, and the diameter and length of the mounting portion 102*c* are respectively 0.3 mm and 3.0 mm. An example of dimensions of each of the second wire pins is shown in FIG. 14. Referring to FIG. 14, each of the second wire pins 104 is formed of an end portion 104*a*, a supporting portion 104*b* and a mounting portion 104*c* to be fixed at the end of the armature 113. The diameter and length of the end portion 104*a* are respectively 0.2 mm, equal to those of the end portion 102*a* of each of the first wire pins 102. The diameter and length of the supporting portion 104*b* are respectively 0.27 mm and 28.5 mm and the diameter and length of the mounting portion 104*c* are respectively 0.27 mm and 3.0 mm.

In the mechanism for driving the wire pin by use of the natural vibration of the leaf spring 111, the frequency F of a wire pin is in inverse proportion to the square root of the moving mass.

In a case where a wire pin as shown in FIG. 15 is used, the moving mass m relating to a single wire pin is the sum of the mass of the end portion (a), the mass of the supporting portion (b) and the mass of the remaining portion of the mechanism for driving the wire pin. That is, the moving mass m is calculated in accordance with the following formula;

$$m=\rho\cdot\pi\cdot r^2\cdot 1+\rho\cdot\pi\cdot R^2\cdot L+Q$$

where r is the radius of the end portion (a), 1 is the length of the end portion (a), R is the radius of the supporting portion (b), L is the length of the supporting portion (b), Q is the mass of the remaining portion of the mechanism, and $\rho$ is the weight density of the wire pin.

Figure 16:
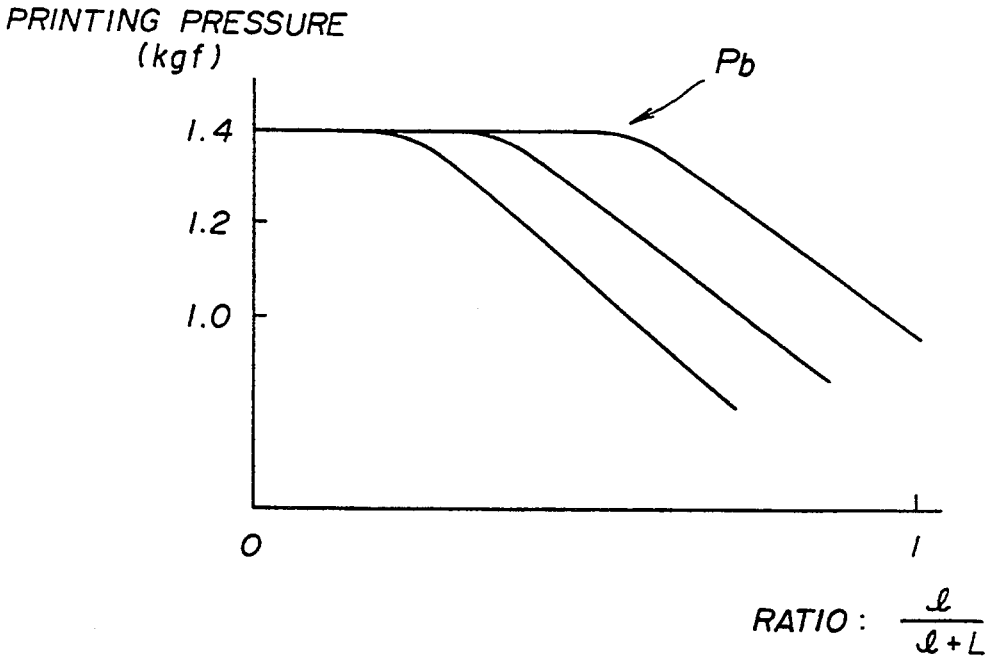
FIG. 16 is a graph showing a printing pressure.

Regarding the printing pressure, when the ratio of the length 1 of the end portion (a) to the total length (1+L) of the end portion (a) and the supporting portion (b) is equal to or greater than a predetermined value, buckling occurs in the wire pin and the printing pressure is reduced. The buckling point Pb at which the buckling starts to occur depends on the ratio 1/(1+L), as shown in FIG. 16. In a case where the radius r of the end portion (a) is constant, the smaller the radius of the supporting portion (b), the smaller the value of the ratio 1/(1+L) corresponding to the buckling point Pb is.

In the printing head formed of the front printing head 103 and the rear printing head 105 as shown in FIG. 11, the second wire pin of the rear printing head 105 is longer than the first wire pin of the front printing head 103. Thus, if the radius R of the supporting portion (b) of the second wire pin is equal to that of the supporting portion (b) of the first wire pin, the moving mass m relating to the second wire pin is greater than that relating to the first wire pin, and the driving frequency of the second wire pin is less than that of the first wire pin.

In this embodiment shown in FIGS. 13 and 14, the supporting portion (b) of the second wire pin 104 is thinner than that of the first wire pin 102 (shorter than the second wire pin 104), so that the moving mass relating to the second wire pin 104 is prevented from being increased. As has been described above, due to the adjustment of the lengths l and L of the end and supporting portions (a) and (b) and of the radiuses r and R of the end and supporting portions (a) and (b), a sufficient printing pressure and a sufficient driving frequency of the first and second wire pins 102 and 104 can be obtained. In addition, the printing pressure and the driving frequency of the first wire pin can be respectively approximately made equal to the printing pressure and the driving frequency of the second wire pin.

In this embodiment shown in FIGS. 13 and 14, the moving mass m of the first wire pin 102 provided in the front printing head 103 is equal to 0.00532 g (m=0.00532) and the moving mass m of the second wire pin 104 provided in the rear printing head 105 is equal to 0.0152 g (m=0.0152). The moving mass Q of the other portion in the front printing head 103 is equal to 0.04 g (Q=0.04), and the moving mass Q of the other portion in the rear printing head 105 is equal to 0.35 g (Q=0.35). The spring constant K of the leaf spring 111 in the front printing head 103 is equal to 0.86 kgf/mm (K=0.86 kgf/mm), and the spring constant K of the leaf spring 111 in the rear printing head 105 is equal to 1.0 kgf/mm. In this case, the driving frequency $F_1$ of the first wire pin 102 is approximately equal to the driving frequency $F_2$ of the second wire pin 104, as indicated by following equations.

$$F_1 = \tfrac{1}{2}\pi \cdot [(0.86 \times 9.8 \times 10^3)/[(5.32 + 40) \times 10^{-6}]]^{-2} = 2.17 \times 10^3 \text{ (Hz)}$$

$$F_2 = \tfrac{1}{2}\pi \cdot [(1.0 \times 9.8 \times 10^3)/[(15.2 + 35) \times 10^{-6}]]^{-2} = 2.22 \times 10^3 \text{ (Hz)}$$

In addition, the strain energy in the leaf spring 111 of the front printing head 103 is equal to $0.516 \times 10^{-3}$ joule, and the strain energy in the leaf spring 111 of the rear printing head 105 is equal to $0.60 \times 10^{-3}$ joule, as indicated by the following formulas.

$$\tfrac{1}{2}Kx^2 = \tfrac{1}{2} \times 0.86 \times 9.8 \times 10^3 \times (0.35 \times 10^{-3})^2 = 0.516 \times 10^{-3} \text{ (joule)}$$

$$\tfrac{1}{2}Kx^2 = \tfrac{1}{2} \times 1 \times 9.8 \times 10^3 \times (0.35 \times 10^{-3})^2 = 0.60 \times 10^{-3} \text{ (joule)}$$

It is assumed that the kinetic energy is 40% of the strain energy. In this case, the kinetic energy of the first wire pin 102 is equal to $0.21 \times 10^{-3}$, and the kinetic energy of the second wire pin 104 is equal to $0.24 \times 10^{-3}$. The energy loss (e.g. the friction loss) of the second wire pin 104 is greater than that of the first wire pin 102. On the basis of the kinetic energy and the energy loss, the printing pressure of the first wire pin 102 is calculated as 1.5 kgf. The printing pressure of the second wire pin 104 is calculated as 1.4 kgf. That is, the printing pressure of the first wire pin 102 provided in the front printing head 103 is approximately equal to that of the second wire pin 104 provided in the rear printing head 105.

Dimensional conditions of the first wire pins 102 of the front printing head 103 and the second wire pins 104 of the rear printing head 105 are not limited to the above values. The first and second wire pins may be formed under the following dimensional conditions 1) through 3).

1) The second wire pin 104 is three times through four times as long as each of the first wire pins 102.

2) The supporting portion (b) of the second wire pin 104 is nine tenths (9/10) as thick as the supporting portion (b) of the first wire pin 102.

3) The ratio $1/(1+L)$ of the second wire pin 104 is in the range 0.8–0.9, and the ratio $1/(1+L)$ of the first wire pin 102 is in the range 0.4–0.6, where 1 is the length of the end portion (a) of each wire pin and L is the length of the supporting portion (b) of each wire pin.

The present invention is not limited to the aforementioned embodiments, and variations and modifications may be made without departing from the scope of the claimed invention.

What is claimed is:

1. A printing head provided in a wire-dot printer comprising:

a first sub-printing head comprising a first head module and a second head module each having a plurality of first wire pins and a plurality of first driving mechanisms for respectively driving said first wire pins, said first and second head modules being mounted on a first planar supporting member with printing ends of said first wire pins being arranged in one or more straight lines and said first head module opposing said second head module;

a second sub-printing head comprising a third head module and a fourth head module each having a plurality of second wire pins and a plurality of second driving mechanisms for respectively driving said second wire pins, said third and fourth head modules being mounted on a second planar supporting member with printing ends of said second wire pins arranged in one or more straight lines and said third head module opposing said fourth head module;

said first and second planar supporting members being connected together in parallel by a connecting mechanism comprising a plurality of spacing rods rigidly engaged thereto, said first supporting member being formed with a plurality of first guide holes and said second supporting member being formed with a plurality of second guide holes;

said first wire pins of said first sub-printing head each passing through a first guide hole and respective second wire pins of said second sub-printing head each passing through a second guide hole and through a first guide hole, said second wire pins being spaced alternately with and parallel to respective first wire pins of said first sub-printing head, each of said pins extending in a direction approximately perpendicular to a printing plane such that the printing ends of said first and second wire pins form an array of one or more straight lines at said printing plane.

2. A printing head as claimed in claim 1, wherein the printing ends of said first and second wire pins are alternately arranged at predetermined intervals along one straight line.

3. A printing head as claimed in claim 1, wherein the printing ends of said first and second wire pins are arranged at predetermined intervals along a plurality of straight lines which are parallel to each other.

4. A printing head as claimed in claim 3, wherein the printing ends of said first and second wire pins are alternately arranged along each of the plurality of straight lines.

5. A printing head as claimed in claim 3, wherein a line along which the printing ends of said wire pins are arranged differs from a line along which the printing ends of said second wire pins are arranged.

6. A printing head as claimed in claim 1, wherein a driving frequency and a printing pressure of each of said first wire pins reciprocated by said first driving mechanism are respectively almost the same as a driving frequency and a printing pressure of each of said second wire pins reciprocated by said second driving mechanism.

7. A printing head as claimed in claim 1, wherein each of said first and second wire pins is formed of an end portion and a supporting portion, said end portion being nearer the printing plane than said supporting portion, and said end portion being thinner than said supporting portion, and wherein a diameter of said end portion of each of said first wire pins is equal to a diameter of said end portion of each of said second wire pins.

8. A printing head as claimed in claim 7, wherein each of said second wire pins is approximately three to four times as long as each of said first wire pins, the supporting portion of each of said second wire pins is nine tenths as thick as the supporting portion of each of said first wire pins, a ratio $1/(1+L)$ of each of said second wire pins is in a range of 0.8–0.9, and a ratio $1/(1+L)$ of each of said first wire pins is in a range of 0.4–0.6, where 1 is a length of the end portion of corresponding first and second wire pins, and L is a length of the supporting portion of corresponding first and second wire pins, such that masses of said corresponding first and second wire pins are substantially equal.

9. A printing head as claimed in claim 1, wherein, each of said first and second driving mechanisms has a leaf spring and a electromagnet used for reciprocating a corresponding one of said first and second wire pins.

10. A printing head as claimed in claim 1, wherein each of said first and second driving mechanism has a moving coil used for reciprocating a corresponding one of said first and second wire pins.

11. A printing head as claimed in claim 1, wherein each of said first and second driving mechanisms has a piezo-electric element used for reciprocating a corresponding one of said first and second wire pins.

12. A printing head as claimed in claim 11, wherein each said piezo-electric element is a laminated type piezo-electric element, and wherein a laminating direction of each said piezo-electric element is approximately perpendicular to the directions in which each of said first and second wire pins is reciprocated.

* * * * *